US012534891B1

(12) United States Patent
Yan

(10) Patent No.: US 12,534,891 B1
(45) Date of Patent: Jan. 27, 2026

(54) SHOWER ARM STRUCTURE

(71) Applicant: Xiamen Galenpoo Kitchen & Bathroom Technology Co., Ltd., Xiamen (CN)

(72) Inventor: Xiaoling Yan, Xiamen (CN)

(73) Assignee: Xiamen Galenpoo Kitchen & Bathroom Technology Co., Ltd., Xiamen (CN)

( * ) Notice: Subject to any disclaimer, the term of this patent is extended or adjusted under 35 U.S.C. 154(b) by 0 days.

(21) Appl. No.: 19/291,227

(22) Filed: Aug. 5, 2025

(30) Foreign Application Priority Data

Jul. 22, 2025 (CN) ..... 202521532307.6

(51) Int. Cl.
*E03C 1/04* (2006.01)

(52) U.S. Cl.
CPC ..... *E03C 1/0408* (2013.01); *E03C 2201/40* (2013.01)

(58) Field of Classification Search
CPC ..... E03C 1/0408; E03C 2201/40
See application file for complete search history.

(56) References Cited

FOREIGN PATENT DOCUMENTS

| | | | | |
|---|---|---|---|---|
| CN | 221511709 U | 8/2024 | | |
| CN | 221567340 U | 8/2024 | | |
| CN | 221711756 U | 9/2024 | | |
| WO | WO-0100938 A1 * | 1/2001 | ..... | E03C 1/04 |

* cited by examiner

*Primary Examiner* — P. Macade Nichols
(74) *Attorney, Agent, or Firm* — Nitin Kaushik

(57) ABSTRACT

The present invention discloses a shower arm structure, achieving a built-in design of a filter element and facilitating replacement. The shower arm structure includes a shower arm body, a filter element, and a sealing cap. The shower arm body has a front surface provided with a mounting cavity, and a back surface provided with a water inlet hole communicating with a shaft end of the mounting cavity; the filter element is disposed in the mounting cavity; the sealing cap is detachably connected at an opening of the mounting cavity and fixes the filter element; and water in the water inlet hole enters the filter element and is filtered before flowing out, and is transported outward through a water path of the shower arm body.

10 Claims, 4 Drawing Sheets

SHOWER ARM STRUCTURE

CROSS-REFERENCE TO RELATED APPLICATIONS

The application claims priority to Chinese patent application No. 202521532307.6, filed on Jul. 22, 2025, the entire contents of which are incorporated herein by reference.

TECHNICAL FIELD

The present invention pertains to the technical field of bathroom equipment, particularly to a shower arm structure.

BACKGROUND

Currently, in addition to a shower rod, a top spray shower may be connected to a water outlet connector on a wall via a shower arm, which has the advantage of a simple structure.

To improve the showering effect, many handheld showers with filtering functions have appeared on the market, whereas top spray showers with filtering functions are rare, as top spray showers are generally mounted at a higher position, making it difficult to replace the filter element therein after mounting. To address this, some manufacturers have developed designs with an external filter element, where water flow entering the shower arm is first directed through a water pipe to the external filter element for filtration, and the filtered water is then guided back to the water path of the shower arm. The design of the external filter element requires an additional housing to accommodate the filter element and related structures to fix the housing, and it extends the length of the water path, further reducing flow rate and affecting water output when water pressure is insufficient. Moreover, the external filter element impacts the simplicity of the product's appearance, reducing the purchase desire of some customers.

SUMMARY

A main objective of the present invention is to provide a shower arm structure, which addresses the problems existing in the prior art, achieving a built-in design of a filter element and facilitating replacement.

To achieve the above objective, the solution of the present invention is as follows:

A shower arm structure is provided, including a shower arm body, a filter element, and a sealing cap. The shower arm body has a front surface provided with a mounting cavity, and a back surface provided with a water inlet hole communicating with a shaft end of the mounting cavity; the filter element is disposed in the mounting cavity; the sealing cap is detachably connected at an opening of the mounting cavity and fixes the filter element; and water in the water inlet hole enters the filter element and is filtered before flowing out, and is transported outward through a water path of the shower arm body.

A side edge of the mounting cavity is provided with a water diversion chamber, a side wall of the mounting cavity is provided with a first water channel communicating with the water diversion chamber, the water diversion chamber is used for mounting a switching valve of the shower arm and is provided with a first water outlet and a second water outlet regulated by the switching valve, the first water outlet is configured to communicate with a handheld shower, the second water outlet extends to form a second water channel, and the second water channel bypasses the side edge of the mounting cavity and extends upward to an upper end of the shower arm body to communicate with a top spray shower.

An inner wall of the opening of the mounting cavity is provided with a rotating slot, and a circumferential surface of the sealing cap is provided with a clamping block movably engaged in the rotating slot.

A first sealing ring is disposed between the filter element and a side wall of the mounting cavity at one end close to the water inlet hole, and a second sealing ring is disposed between the scaling cap and an inner wall of the opening of the mounting cavity.

Preferably, the first sealing ring is disposed on circumferential surfaces of both ends of the filter element.

The shower arm structure further includes a magnetic shower holder mounted at a lower end of the shower arm body, where a magnet is built in the magnetic shower holder.

Preferably, the magnetic shower holder is provided with a ball head rotatably engaged with the lower end of the shower arm body.

Preferably, a front surface of the lower end of the shower arm body is provided with a movement groove for rotatably engaging the ball head, a first gasket is disposed in the movement groove, a screw cap is threadedly engaged with an outer wall of the movement groove, a second gasket is disposed in the screw cap, the ball head penetrates the screw cap and the second gasket, and the first gasket and the second gasket are respectively clamped on two sides of the ball head.

Preferably, the first gasket is made of rubber material, and the second gasket is a C-shaped component.

A water inlet connector is mounted at a position of the shower arm body opposite to the water inlet hole.

After the use of the above technical solution, the following technical effects are achieved by the present invention:

In the present invention, as the front surface of the shower arm body is provided with the mounting cavity, the filter element is directly mounted inside the shower arm body, eliminating the need for additional parts to accommodate the filter element or extra water pipes to connect the water path, and as the filter element is directly connected to the water inlet end of the shower arm body, impurities filtered out are isolated at the source end, preventing accumulation of the impurities in the water path of the shower arm body. Additionally, the mounting cavity is located near the lower end, closer to the user, facilitating replacement of the filter element.

DESCRIPTION OF REFERENCE NUMERALS

1—shower arm body; 11—mounting cavity; 111—rotating slot; 12—water inlet hole; 13—water diversion chamber; 14—first water channel; 15—first water outlet; 16—second water outlet; 17—second water channel; 18—movement groove; 2—filter element; 21—water passage hole; 22—filter material; 3—sealing cap; 31—clamping block; 4—switching valve;

5—first sealing ring; 6—second sealing ring; 7—magnetic shower holder; 71—magnet; 72—ball head; 8—first gasket; 9—screw cap; and 10—second gasket.

DETAILED DESCRIPTION OF THE EMBODIMENTS

To further explain the technical solution of the present invention, a detailed elaboration is provided below through specific embodiments.

Figure 1:
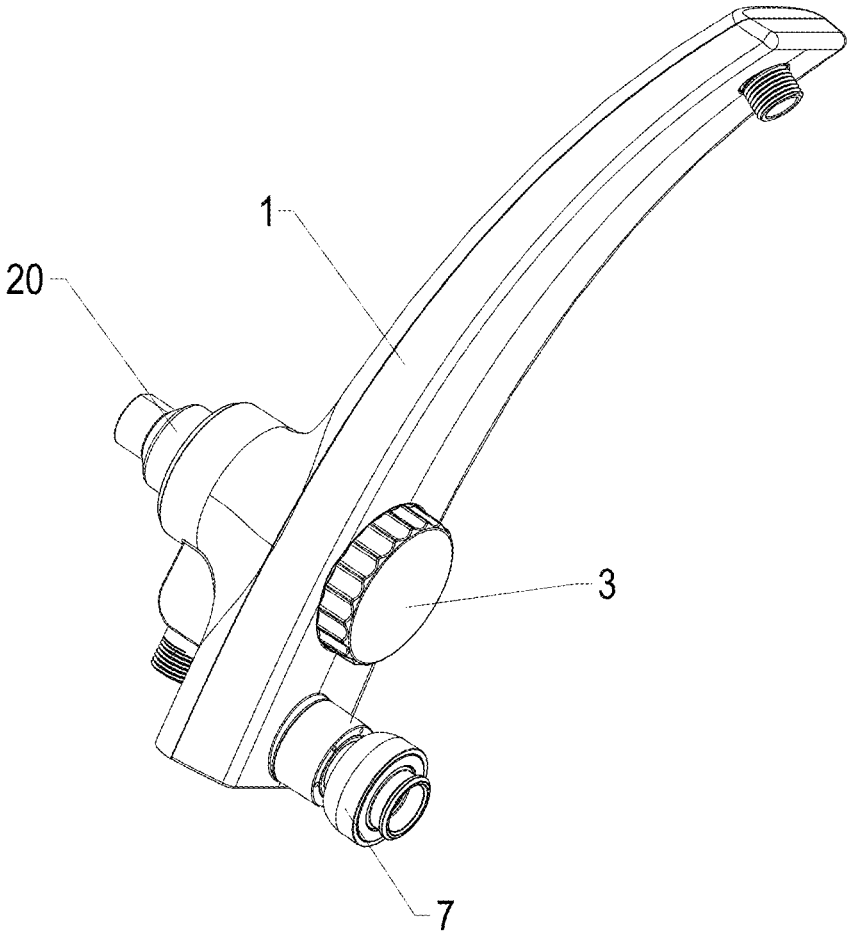
FIG. 1 is a perspective view according to a specific embodiment of the present invention.
Figure 2:
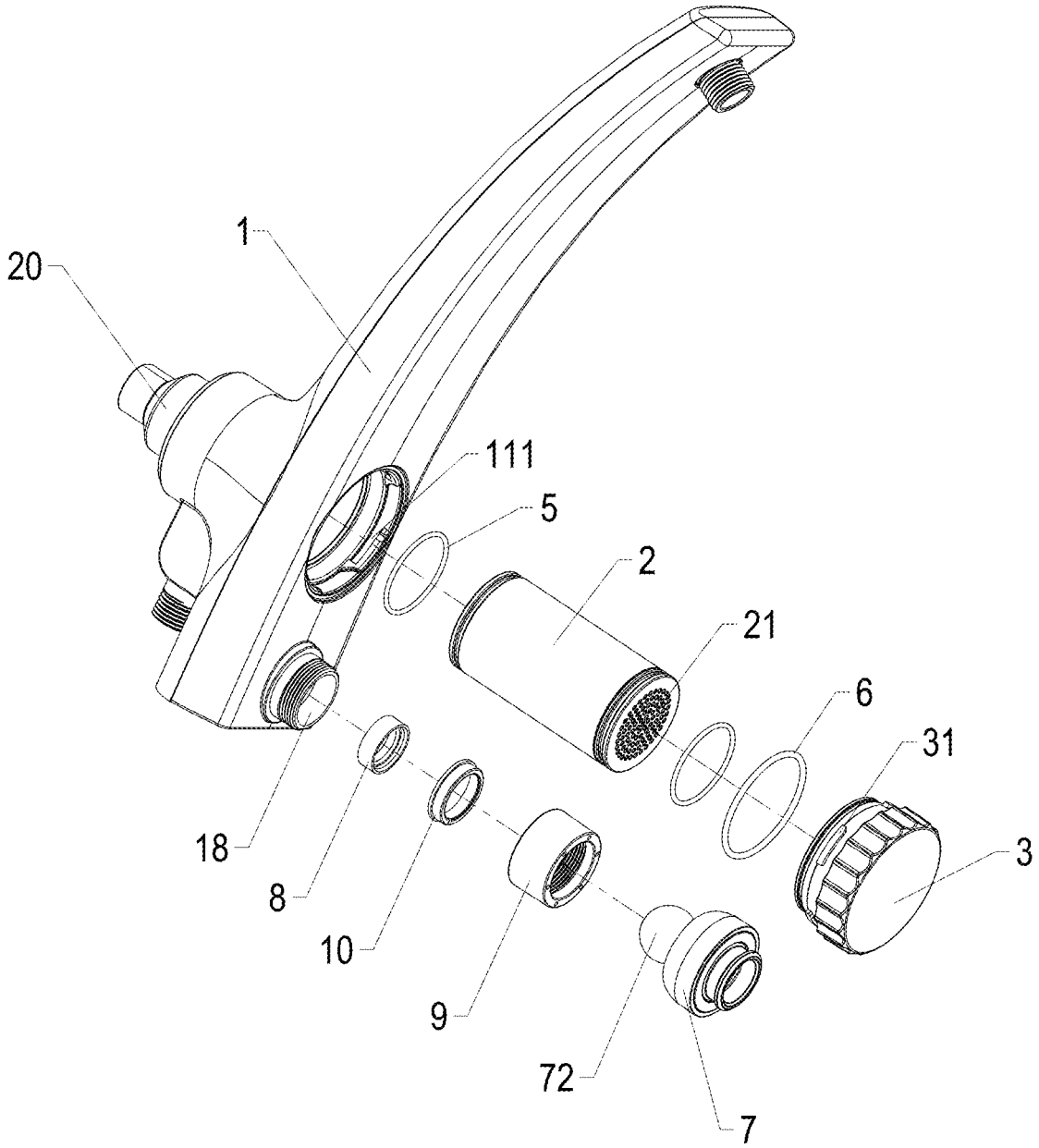
FIG. 2 is an exploded view of a partial structure according to a specific embodiment of the present invention.
Figure 3:
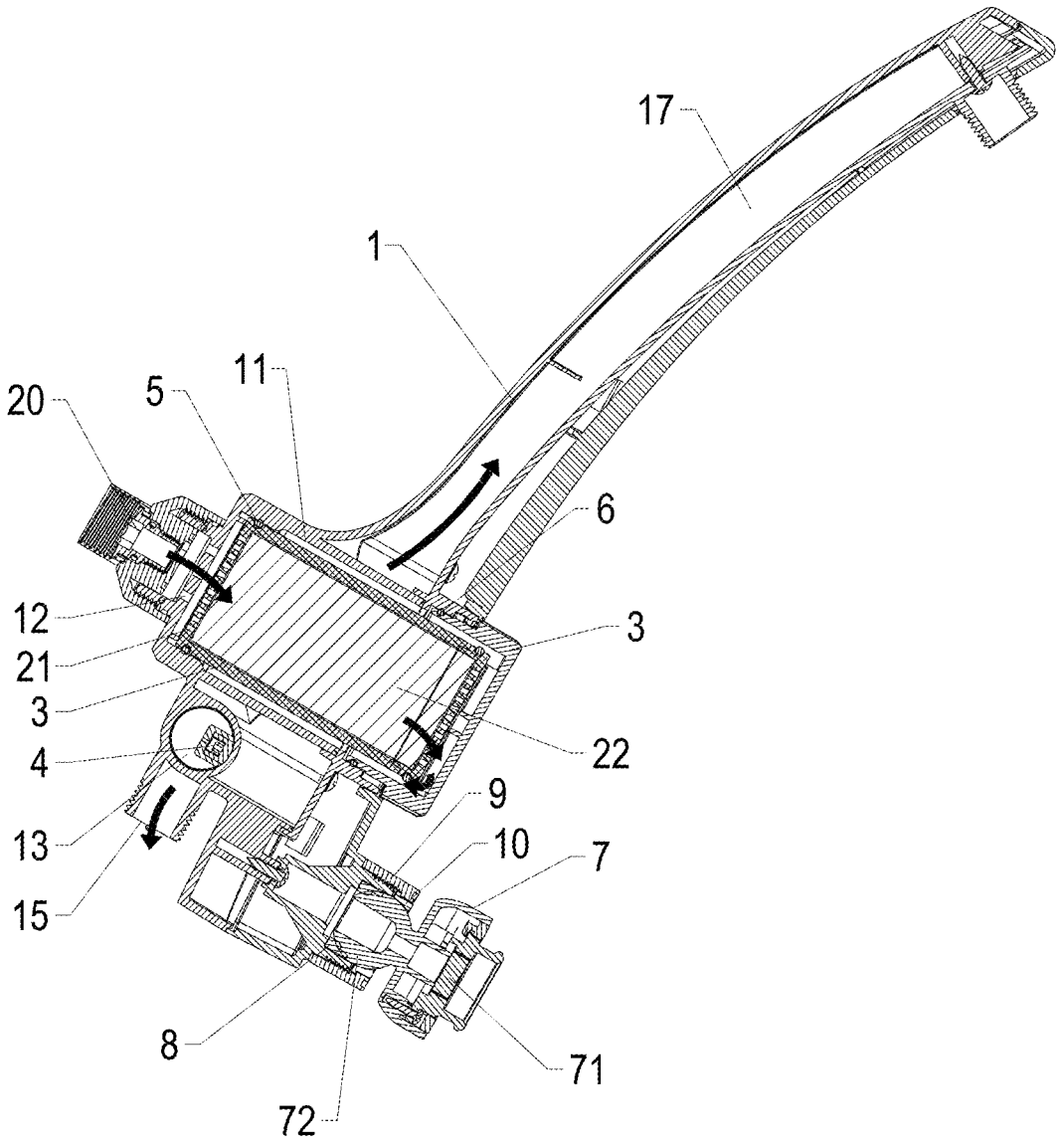
FIG. 3 is a cross-sectional view according to a specific embodiment of the present invention.
Figure 4:
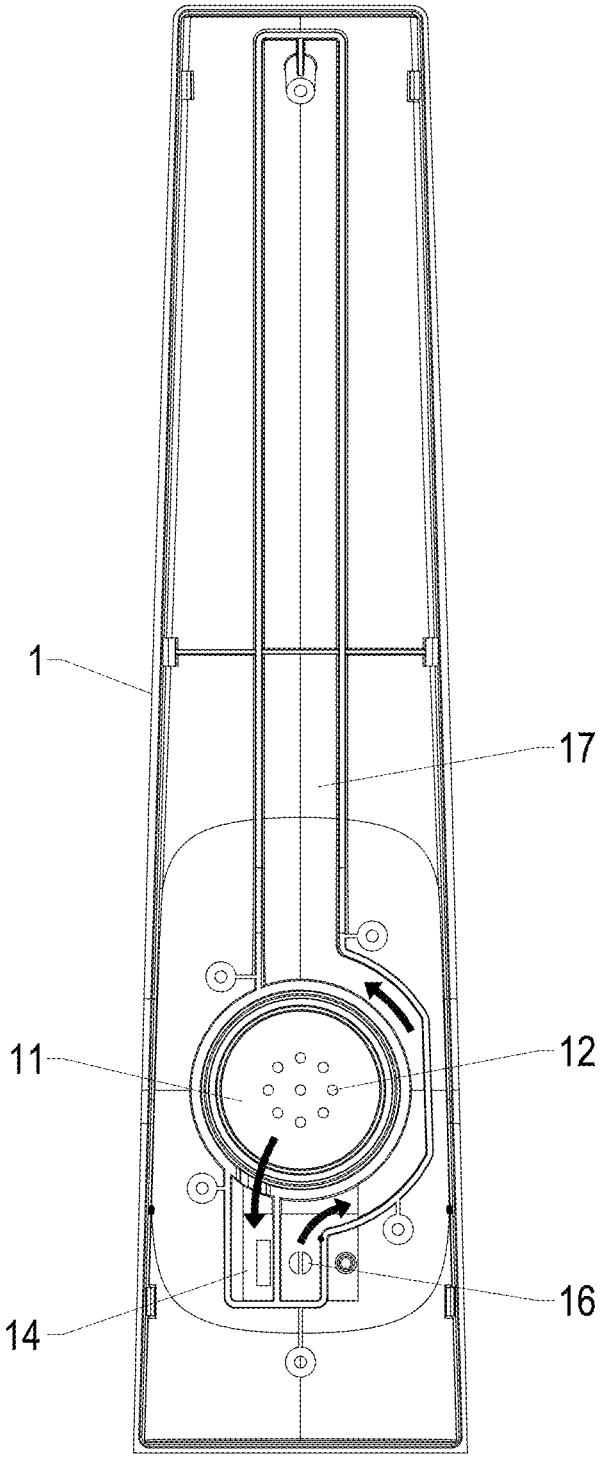
FIG. 4 is a schematic diagram of a water flow direction according to a specific embodiment of the present invention.

As shown in FIGS. 1 to 4, the present invention discloses a shower arm structure, including a shower arm body 1, a filter element 2, and a sealing cap 3.

The shower arm body 1 has a front surface provided with a mounting cavity 11 near a lower end, and a back surface provided with a water inlet hole 12 communicating with a shaft end of the mounting cavity 11.

The filter element 2 is disposed in the mounting cavity 11.

The sealing cap 3 is detachably connected at an opening of the mounting cavity 11 and fixes the filter element 2.

Water in the water inlet hole 12 enters the filter element 2 and is filtered before flowing out, and is transported outward through a water path of the shower arm body 1.

Through the above solution in the present invention, as the front surface of the shower arm body 1 is provided with the mounting cavity 11, the filter element 2 is directly mounted inside the shower arm body 1, eliminating the need for additional parts to accommodate the filter element 2 or extra water pipes to connect the water path, and as the filter element 2 is directly connected to the water inlet end of the shower arm body 1, impurities filtered out are isolated at the source end, preventing accumulation of the impurities in the water path of the shower arm body 1. Additionally, the mounting cavity 11 is located near the lower end, closer to the user, facilitating replacement of the filter element 2.

Specific embodiments of the present invention are shown below.

A side edge of the mounting cavity 11 is provided with a water diversion chamber 13, and a side wall of the mounting cavity 11 is provided with a first water channel 14 communicating with the water diversion chamber 13. The water diversion chamber 13 is used for mounting a switching valve 4 of the shower arm and is provided with a first water outlet 15 and a second water outlet 16 regulated by the switching valve 4. The switching valve 4 can adjust the opening degree of the first water outlet 15 and the second water outlet 16 to achieve opening and closing. The first water outlet 15 is configured to communicate with a handheld shower. The second water outlet 16 extends to form a second water channel 17, and the second water channel 17 bypasses the side edge of the mounting cavity 11 and extends upward to an upper end of the shower arm body 1 to communicate with a top spray shower.

The sealing cap 3 is detachably connected to the opening of the mounting cavity 11 by a rotational engagement method. Specifically, an inner wall of the opening of the mounting cavity 11 is provided with a rotating slot 111, and a circumferential surface of the sealing cap 3 is provided with a clamping block 31 movably engaged in the rotating slot 111, making assembly casier and more efficient.

A first sealing ring 5 is disposed between the filter element 2 and a side wall of the mounting cavity 11 at one end close to the water inlet hole 12, and an end face of the filter element 2 at this end is provided with several water passage holes 21, with a filter material 22 disposed inside the filter element 2. A second sealing ring 6 is disposed between the sealing cap 3 and an inner wall of the opening of the mounting cavity 11, improving the scaling and leak-proof performance. The former ensures that water flow from the water inlet hole 12 can only enter the filter element 2 from the end face of the filter element 2, ensuring the water flow is filtered through the filter material 22, and the latter prevents leakage at the position of the sealing cap 3. In this embodiment, water passage holes 21 and the first sealing ring 5 are provided on circumferential surfaces of both ends of the filter element 2, allowing mounting without a specific orientation, and eliminating the need to deliberately adjust the orientation of the filter element 2 during mounting of the filter element 2.

The present invention further includes a magnetic shower holder 7 mounted at a lower end of the shower arm body 1, where a magnet 71 is built in the magnetic shower holder 7, enabling magnetic fixation of a handheld shower.

Further, the magnetic shower holder 7 is provided with a ball head 72 rotatably engaged with the lower end of the shower arm body 1, allowing the angle of the magnetic shower holder 7 to be adjusted for more flexible use.

Next, a front surface of the lower end of the shower arm body 1 is provided with a movement groove 18 for rotatably engaging the ball head 72, and a first gasket 8 is disposed in the movement groove 18. A screw cap 9 is threadedly engaged with an outer wall of the movement groove 18, and a second gasket 10 is disposed in the screw cap 9. The ball head 72 penetrates the screw cap 9 and the second gasket 10, and the first gasket 8 and the second gasket 10 are respectively clamped on two sides of the ball head 72. Thus, relying on the elasticity of the first gasket 8 and the second gasket 10, when the screw cap 9 is tightened, the first gasket 8 and the second gasket 10 are clamped and transfer the applied pressure to the surface of the ball head 72, providing sufficient friction to prevent the ball head 72 from rotating, and making rotation of the ball head 72 difficult, thereby fixing the entire magnetic shower holder 7 in place. After the screw cap 9 is loosened, the ball head 72 is no longer restricted, making rotation of the ball head 72 casier, thus allowing the angle of the magnetic shower holder 7 to be adjusted. The opposing surfaces of the first gasket 8 and the second gasket 10 may be configured as curved surfaces to achieve spherical engagement with the ball head 72, allowing the two gaskets to fit more closely to the surface of the ball head 72.

Additionally, the first gasket 8 is made of rubber material, and the second gasket 10 is a C-shaped component, facilitating deformation to allow penetration by the ball head 72.

A water inlet connector 20 is mounted at a position of the shower arm body 1 opposite to the water inlet hole 12, and configured for connecting to a wall-mounted water outlet connector, enabling the shower arm to be fixed on the wall.

In this embodiment, the shower arm body 1 is designed with a separate front cover and rear shell, facilitating the formation of the internal water path.

The above embodiments and drawings do not limit the product form and style of the present invention, and any appropriate changes or modifications made by those skilled in the art should be considered as not departing from the patent scope of the present invention.

What is claimed is:

1. A shower arm structure, comprising:

a shower arm body, a filter element, and a sealing cap, wherein the shower arm body has a front surface provided with a mounting cavity, and a back surface provided with a water inlet hole communicating with a shaft end of the mounting cavity;

the filter element is disposed in the mounting cavity, wherein the filter element is provided with a plurality of water passage holes on two end faces of the filter element for water inflow, a filter material is disposed inside the filter element, the filter element is configured such that water flow passes axially through the filter material for filtration;

the sealing cap is detachably connected at an opening of the mounting cavity and configured to securely fix the filter element within the shower arm body; and wherein all water flow from the water inlet hole first enters an interior of the filter element through the water passage holes on one end face of the filter element and undergoes an axial filtration, filtered water flow thereafter enters a water diversion chamber within the shower arm body and is divided into at least two water flows, supplied to a first water outlet end for a handheld shower and a second outlet end for a top spray shower.

2. The shower arm structure according to claim 1, wherein a side edge of the mounting cavity is provided with the water diversion chamber, a side wall of the mounting cavity is provided with a first water channel communicating with the water diversion chamber, the water diversion chamber is used for mounting a switching valve of the shower arm and is provided with a first water outlet and a second water outlet regulated by the switching valve, the first water outlet is configured to communicate with the handheld shower, the second water outlet extends to form a second water channel, and the second water channel bypasses the side edge of the mounting cavity and extends upward to an upper end of the shower arm body to communicate with the top spray shower.

3. The shower arm structure according to claim 1, wherein an inner wall of the opening of the mounting cavity is provided with a rotating slot, and a circumferential surface of the sealing cap is provided with a clamping block movably engaged in the rotating slot.

4. The shower arm structure according to claim 1, wherein a first sealing ring is disposed between the filter element and a side wall of the mounting cavity at one end close to the water inlet hole, and a second sealing ring is disposed between the sealing cap and an inner wall of the opening of the mounting cavity.

5. The shower arm structure according to claim 4, wherein the first sealing ring is disposed on circumferential surfaces of both ends of the filter element.

6. The shower arm structure according to claim 1, further comprising a magnetic shower holder mounted at a lower end of the shower arm body, wherein a magnet is built in the magnetic shower holder.

7. The shower arm structure according to claim 6, wherein the magnetic shower holder is provided with a ball head rotatably engaged with the lower end of the shower arm body.

8. The shower arm structure according to claim 7, wherein a front surface of the lower end of the shower arm body is provided with a movement groove for rotatably engaging the ball head, a first gasket is disposed in the movement groove, a screw cap is threadedly engaged with an outer wall of the movement groove, a second gasket is disposed in the screw cap, the ball head penetrates the screw cap and the second gasket, and the first gasket and the second gasket are respectively clamped on two sides of the ball head.

9. The shower arm structure according to claim 8, wherein the first gasket is made of rubber material, and the second gasket is a C-shaped component.

10. The shower arm structure according to claim 1, wherein a water inlet connector is mounted at a position of the shower arm body opposite to the water inlet hole.

* * * * *